United States Patent [19]

Ogawa et al.

[11] 3,960,446

[45] June 1, 1976

[54] ELECTROSTATIC COPYING APPARATUS

[75] Inventors: Masaya Ogawa; Kenichi Wada, both of Sakai; Yoshihiko Yasue, Toyohashi, all of Japan

[73] Assignee: Minolta Camera Kabushiki Kaisha, Azuchi, Japan

[22] Filed: Apr. 30, 1974

[21] Appl. No.: 465,674

[30] Foreign Application Priority Data

May 8, 1973 Japan ..... 48-50869

[52] U.S. Cl. ..... 355/13; 355/3 R; 355/14

[51] Int. Cl.[2] ..... G03G 15/00

[58] Field of Search ..... 355/13, 3 R, 8, 14, 355/16, 50, 51; 271/DIG. 2

[56] References Cited

UNITED STATES PATENTS

| | | | |
|---|---|---|---|
| 3,062,094 | 11/1962 | Mayo | 355/11 |
| 3,076,092 | 1/1963 | Mott | 355/3 R |
| 3,480,361 | 11/1969 | Doi et al. | 355/16 |
| 3,578,859 | 5/1971 | Stillings | 355/3 R |
| 3,588,242 | 6/1971 | Berlier et al. | 355/16 |
| 3,612,682 | 10/1971 | Shelffo et al. | 355/14 |
| 3,635,554 | 1/1972 | Hodges | 355/8 |
| 3,695,756 | 10/1972 | Smith | 355/3 R |
| 3,700,326 | 10/1972 | Murgas et al. | 355/14 |
| 3,746,442 | 7/1973 | Davidson | 355/3 R |
| 3,746,443 | 7/1973 | Hickey | 355/14 |
| 3,771,867 | 11/1973 | Moser | 355/14 |

*Primary Examiner*—R. L. Moses
*Attorney, Agent, or Firm*—Wenderoth, Lind and Ponack

[57] ABSTRACT

A slit exposure type electrostatic copying apparatus having a photoreceptor surface wound on a rotatory drum movable along a path relative to a plurality of actuable processing stations disposed along the path and wherein the circumference of the photoreceptor drum is made slightly longer than the length of the maximum sized original with the diameter of the drum minimized to such an extent as to be sufficient to perform efficient copying. The machine is equipped with an automatic copy paper feeding mechanism from a roll of paper which can be switched over to a manual insertion by a simple operation, and is also provided with a supplementary light source so as to erase unnecessary charge on the non-latent image formed portion of the photoreceptor surface for better performance and prolonged life of the photoreceptor.

3 Claims, 15 Drawing Figures

(a)

(b)

(c)

Figure 1:
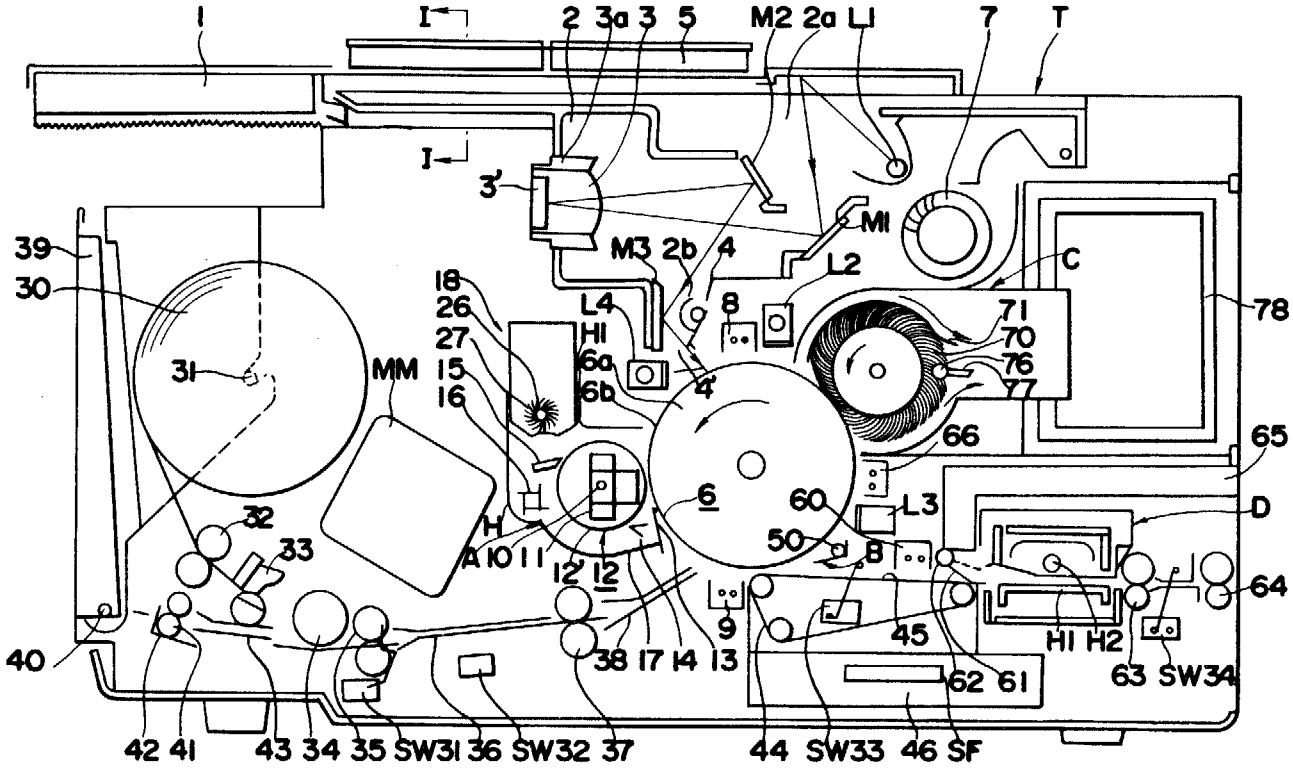

Function both for manual insertion and automatic paper roll feeding

Function only for manual insertion paper feeding

Function only for automatic paper roll feeding

ELECTROSTATIC COPYING APPARATUS

The present invention relates to an electrostatic copying apparatus, and more particularly to a transfer type electrostatic copying apparatus.

In recent years, there has been a demand for smaller size and versatility of copying performance for this type of electrostatic copying apparatuses.

In order to meet such requirements, it is necessary to give careful consideration mainly to the construction of an optical system associated with paper feeding and a photoreceptor drum. Above all, making the photoreceptor drum smaller in diameter has an important effect upon decreasing the size of the appartus.

However, when the photoreceptor drum has been made smaller in size, distortion of images has been caused by the smaller curvature radius of the drum. Needless to say, making the photoreceptor drum smaller in diameter is limited, since various processing stations such as charging, exposing, developing, cleaning, etc. are disposed around the photoreceptor drum. However, in forming the photoreceptor surface by winding a sheet-like photosensitive material around a drum, it has been difficult to make the photoreceptor drum small since the sheet-like photosensitive material has its joint with the beginning and end of the rotation of the drum required to be regulated strictly. The outer periphery of the photoreceptor drum is required to be of, at least, such a length as the maximum size of the original picture to be copied may not come on the joint, and to be, for example, approximately twice as long as the length of the maximum size of the original picture to ensure that each process of reproduction may be effectively conducted during the rotation of the photoreceptor drum.

Also, concerning the multiple purposes of the reproduction performance, for example, usage of a roll of paper as copy paper, and provision of a random cut mechanism have been put into practical application, permitting various sizes of originals to be copied. In this case, for example, in exchanging the roll paper for A row size with the roll paper for B row size, the exchanging operation thereof has been cumbersome especially when the number of copies to be taken is small. It has been particularly inconvenient in cases where copying operation is to be made on paper of rarely used sizes, second originals or on the reverse side of copied paper sheet.

Moreover, in the conventional copying machine of the above described type, the charger for charging the photoreceptor surface uniformly prior to exposure is adapted to function continuously during operation of the copying machine mainly for automatic high speed operation of the copying machine, while the illuminating device for forming an electrostatic latent image on the photoreceptor surface functions intermittently, so that on the photoreceptor surface, the latent-image portion formed by the above illuminating device and the portion without latent image during the turned-off time of the illuminating device are alternately present. The above charger and a transfer device have a high voltage transformer as a common power source adapted to apply voltage to the photoreceptor surface simultaneously by controlling the primary side of the transformer, because the charger and the transfer device are of the same polarity having approximately the same potential with high voltage in the secondary of the transformer (4 to 8 KV), making it difficult to control the time for applying voltage. Accordingly, the portion without the latent image on the photoreceptor surface is charged twice, i.e., at the preliminary charging and the transfer operation with resultant high surface potential, sometimes resulting in dielectric breakdown due to abnormal discharge between the copy paper sheet and the portion without the latent image at the transfer position or unevenly transferred image or shorter life of the photoreceptor due to deterioration thereof.

Furthermore, in the conventional copying apparatus of the above type, controlling the operation of the developing device so as to function in timed relation only to the latent image forming portion of the photoreceptor surface is difficult due to the complication of the developing device, because if the operation of the developing device is incorrectly timed, or in case the developing device is operated continuously, the above portion without the latent image formed is unnecessarily developed, which may result not only in consumption of the developer material more than necessary, but also in earlier deterioration of the rotating cleaner brush of the residual toner removing device for cleaning the photoreceptor surface after transfer or in scattering of the developer material in the copying apparatus.

In order to overcome such disadvantages, an apparatus in which the charge on the non-latent image formed portion is removed in advance by the provision of a supplementary exposure light source which illuminates such non-image formed portion is proposed. However, such a proposed apparatus is complicated in control method because a time lag must be provided between the functionings of the main exposure light source and the supplementary light source, and besides, as the copying machine is of the total exposure type in which the total area of the original is to be exposed at a time, the functioning of the above two exposure light sources must be controlled separately in timed relation to each other, corresponding to the sizes of the original, which requires complicated operation. Besides, the charger is adapted for function in relation to the rotation of the photoreceptor, while the supplementary light source functions after the latent image has been formed on the photoreceptor, so that it is usually impossible to erase the charge in front of the latent image portion which is formed by the initial exposure by the main exposure light source. In order to erase the charge in the above front portion, the erasing operation must be effected after the latent image has been formed.

Accordingly, an essential object of the present invention is to provide an electrostatic copying machine which is compact in size and versatile in copying performance with substantial elimination of the disadvantages inherent in the conventional copying machine.

Another important object of the present invention is to provide an electrostatic copying machine of the above described type which is comparatively simple in construction and easy to operate, employing a slit exposure system with a photoreceptor drum of small diameter.

A further object of the present invention is to provide an electrostatic copying machine of the above described type which employs a supplementary light source to automatically erase unnecessary charge on the photoreceptor surface with improved performance and prolonged life of the photoreceptor.

A still further object of the present invention is to provide an electrostatic copying machine of the above described type in which automatic copy paper feeding from a paper roll or manual insertion of copy paper sheets can be selectively effected by a simple operation.

According to the copying apparatus of the present invention, the relationship between the photoreceptor drum and the components, which constitute various processing stations such as charging, exposing, developing, etc. mounted around the photoreceptor drum is taken into consideration with the photoreceptor drum arranged to make two revolutions per reproduction cycle. As a result, in using the drum around which the sheet-like photosensitive material is wound, with the overall circumference of the photoreceptor drum slightly longer than the length of the maximum size original, the copying apparatus can be made compact to a minimum limitation required for carrying out effective reproduction processes. Furthermore, the automatic paper feeding mechanism equipped with the random cut mechanism can be easily changed over to the manual insertion for versatility of the copy apparatus.

Furthermore, in the copying apparatus according to the present invention the problem of erasing the unnecessary charge on the photoreceptor surface except the latent image formed portion thereof is solved by simply providing a supplementary exposure light source in the vicinity of the main exposure light source which is connected to the latter through a switch so that both light sources are turned on or off alternately, thus positively erasing the charge on the non-latent image formed portion on the photoreceptor surface.

These and other objects and features of the present invention will become apparent from the following description taken in conjunction with the preferred embodiment thereof with reference to the accompanying drawings, in which;

FIG. 1 is a schematic diagram showing a sectional side view of a copying machine according to the present invention.

Figure 2:
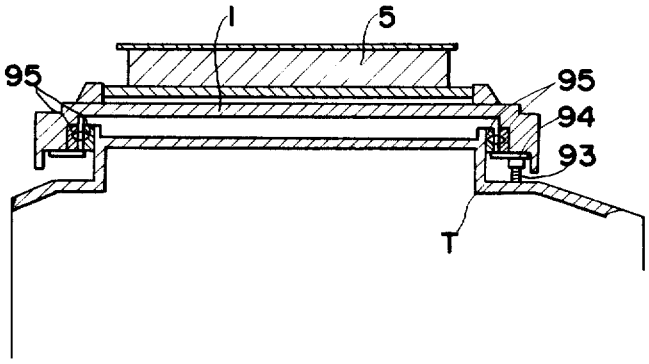
Figure 4:
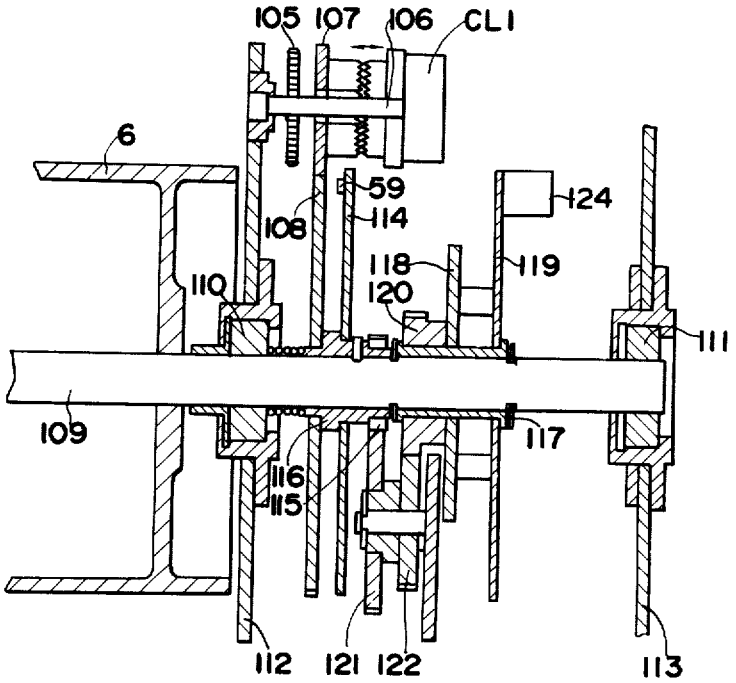
Figure 9:
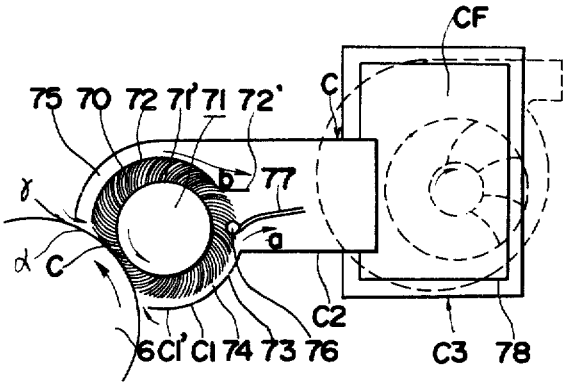
Figure 3:
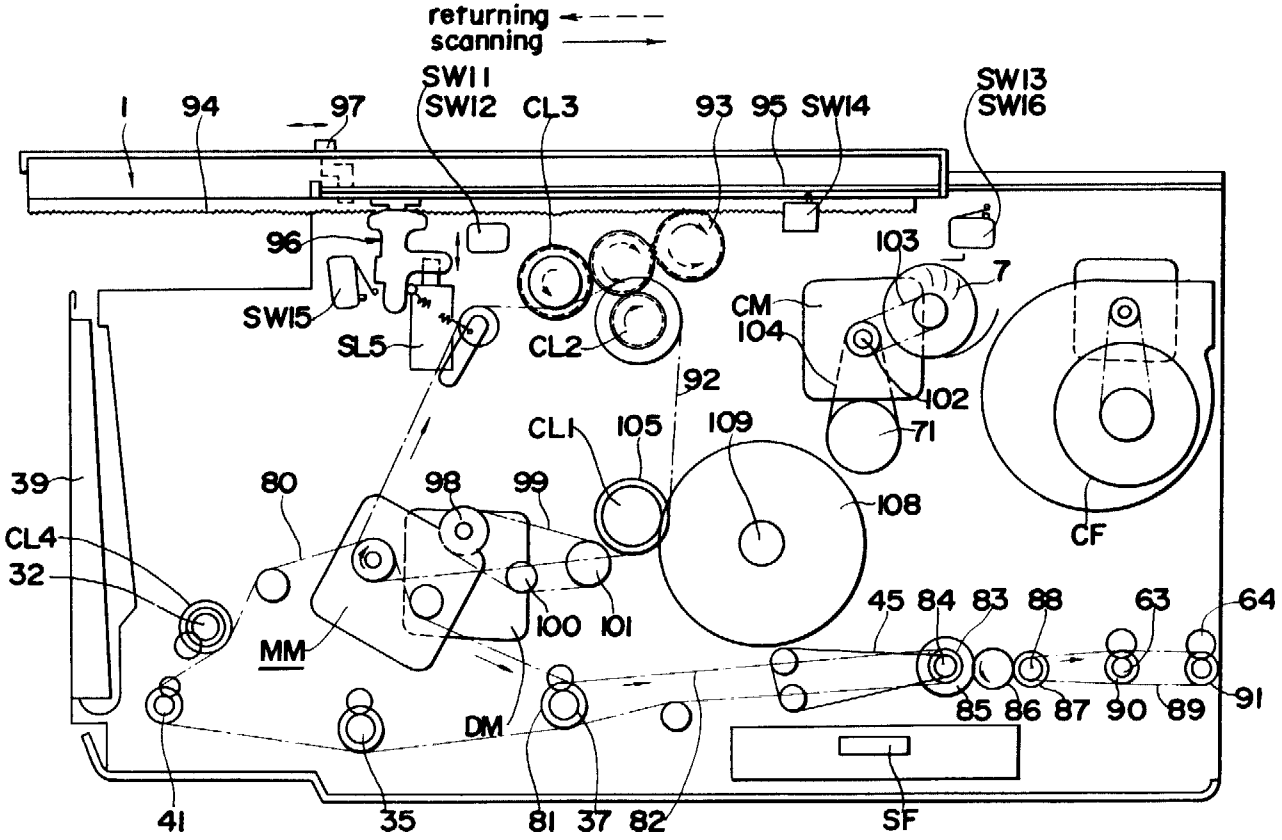
Figure 5:
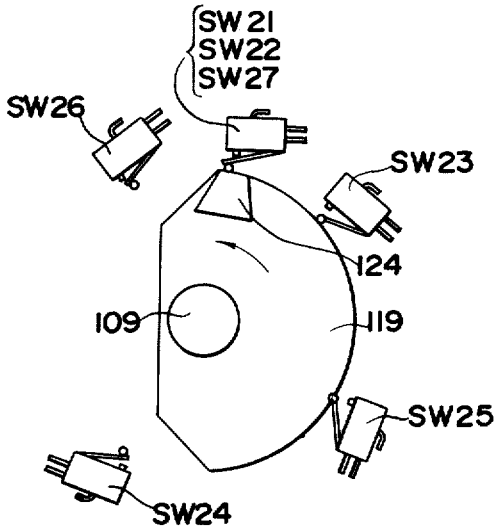
Figure 7:
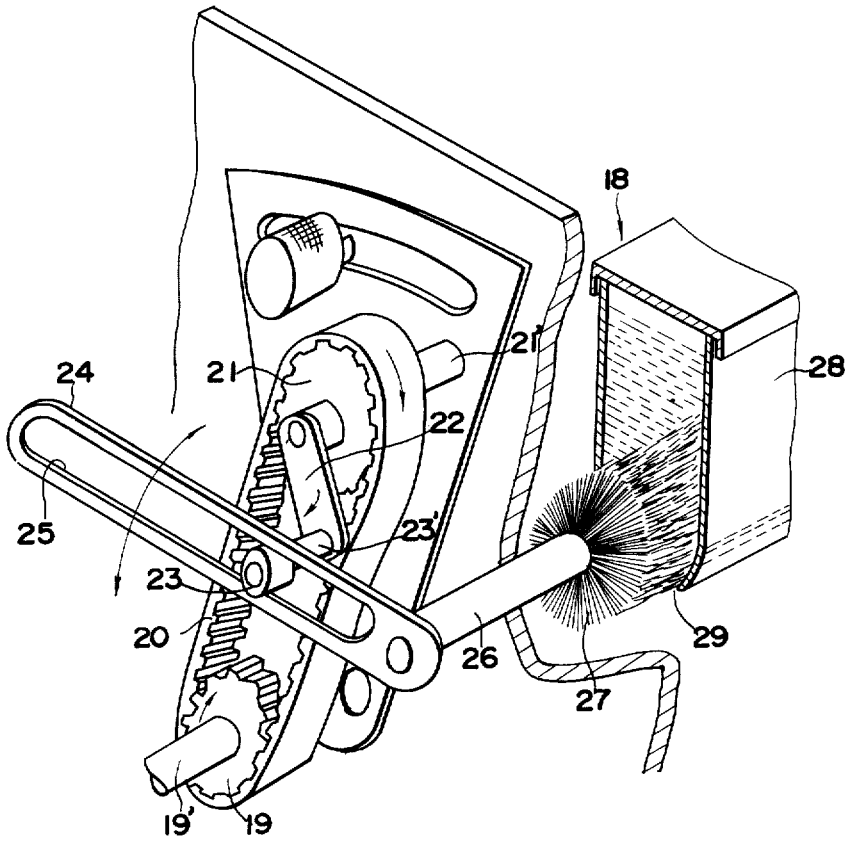
Figure 6:
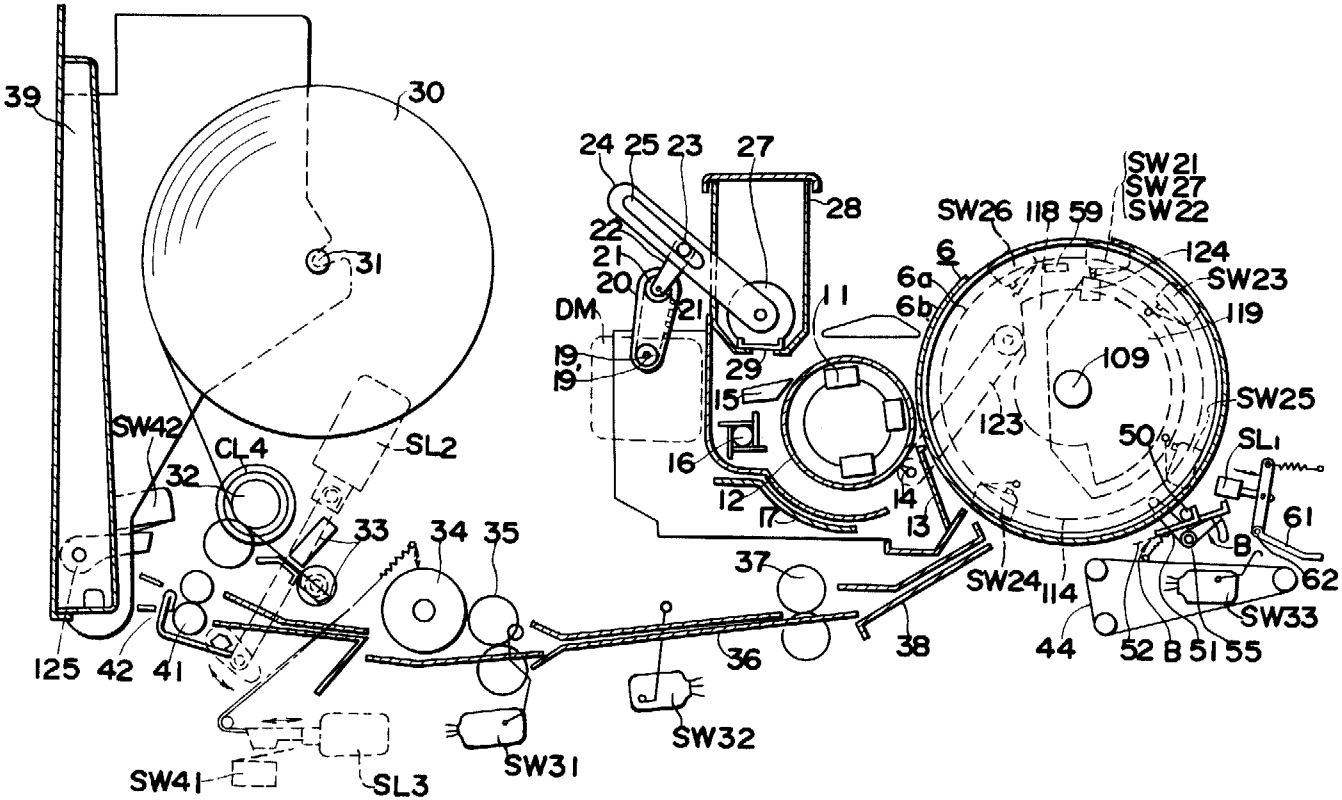
Figure 8:
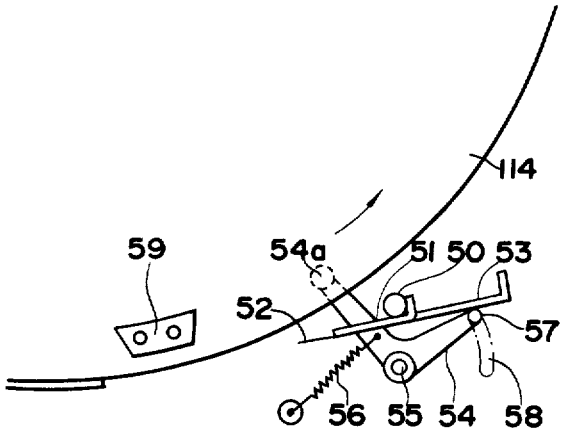
Figure 8:
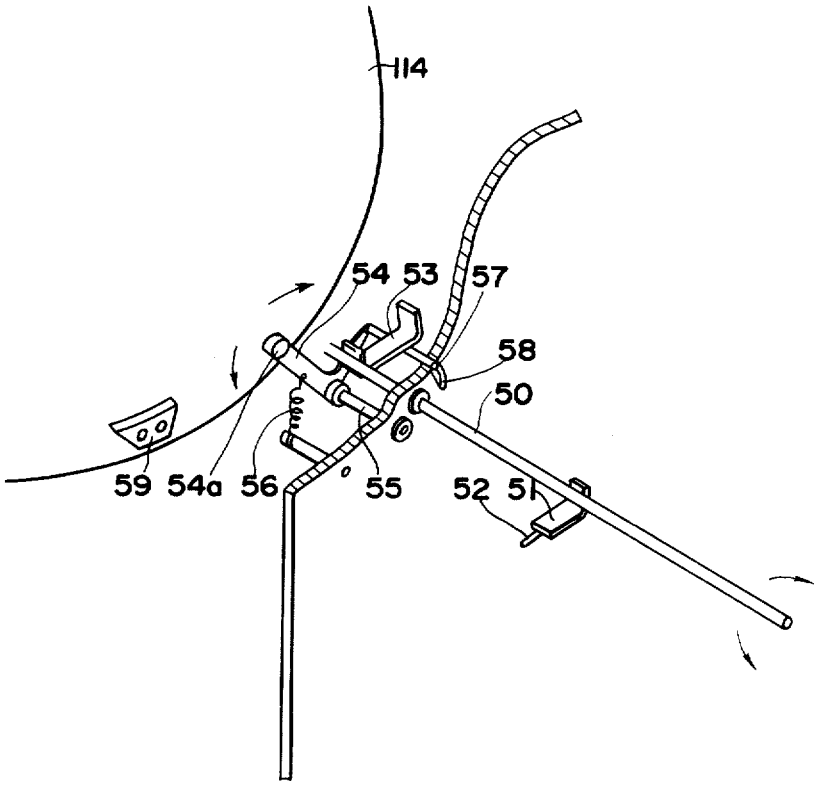
Figure 8:
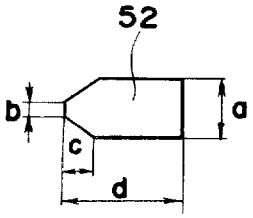
Figure 10:
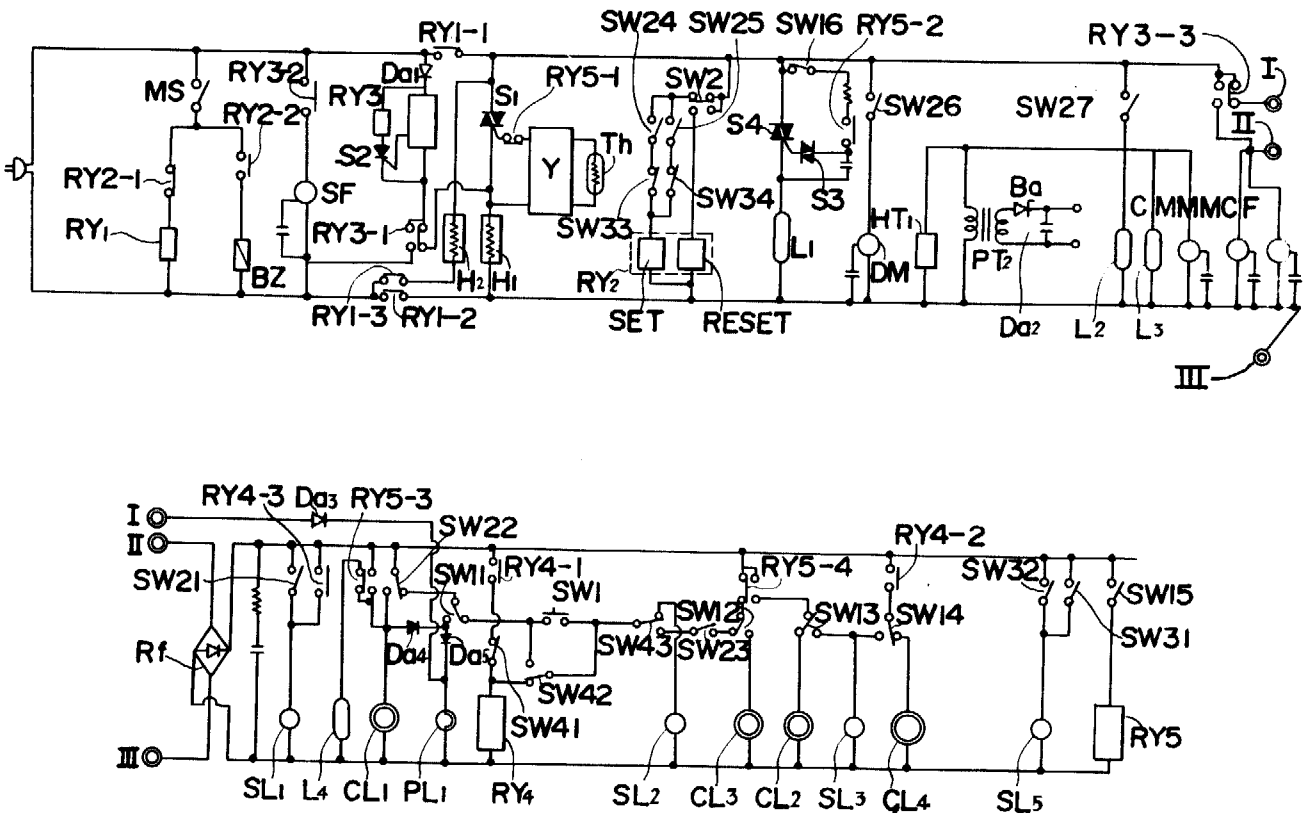
Figure 11:
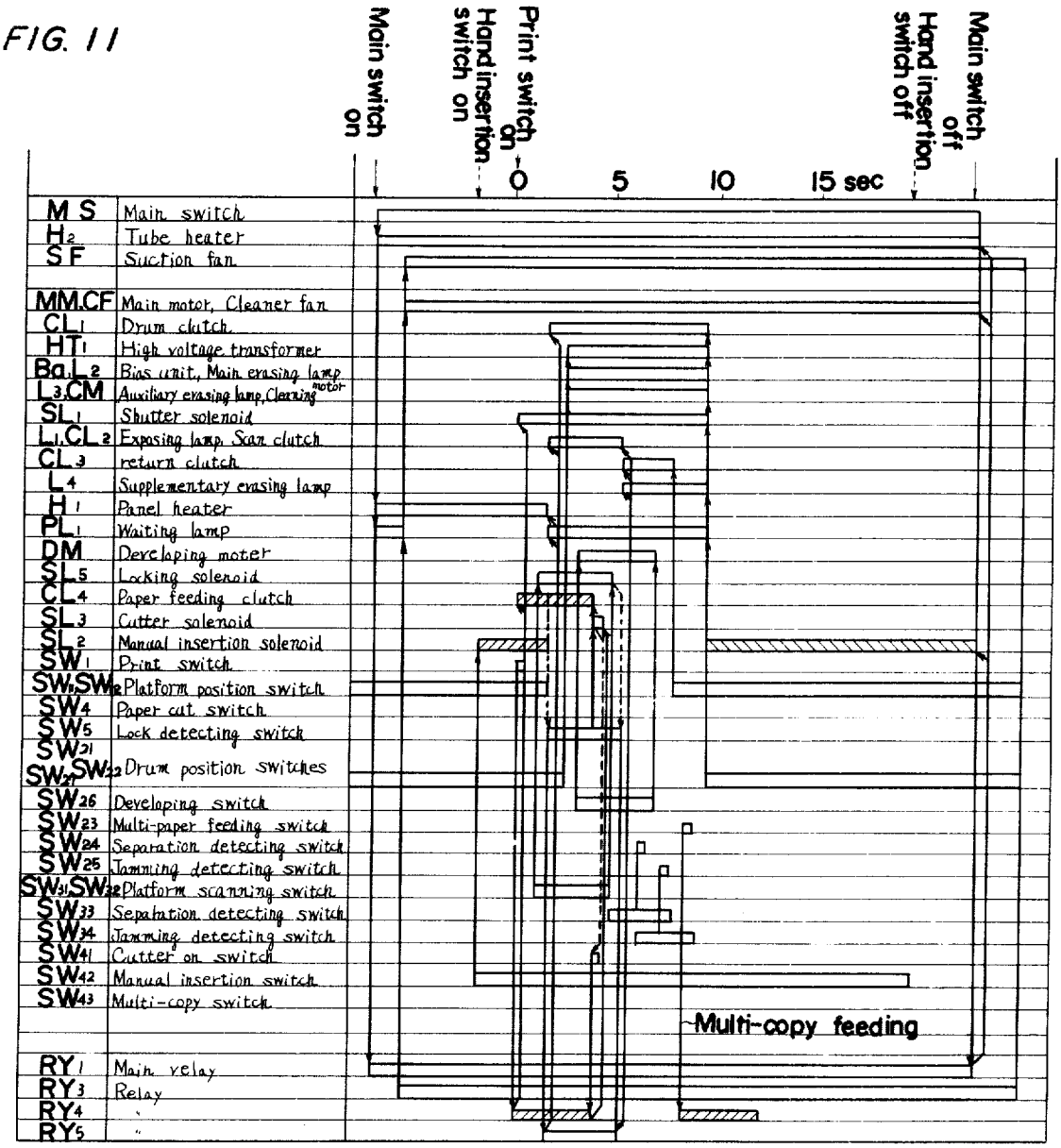
Figure 12:
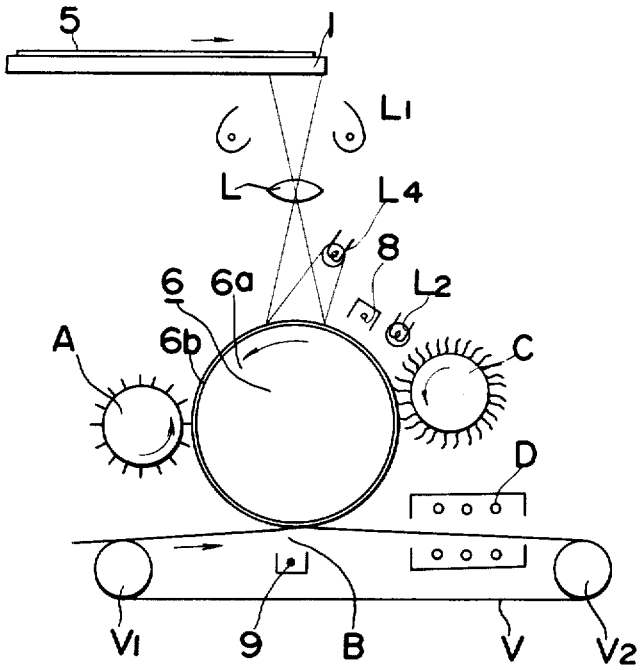
Figure 13:
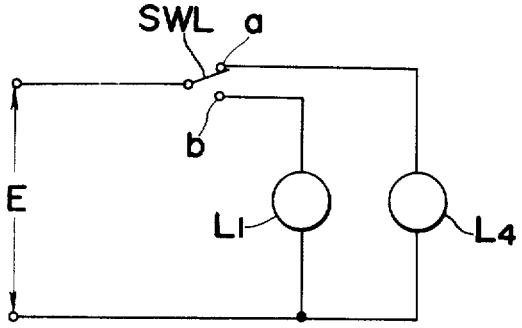

FIG. 2 is a cross sectional view taken along the line I — I in FIG. 1 on an enlarged scale, FIG. 3 is a similar view to FIG. 1, but particularly shows the driving system thereof, FIG. 4 is a cross sectional view, on an enlarged scale, of a drum and mechanism associated therewith employed in the machine of FIG. 1, FIG. 5 is a schematic view showing relation of a cam plate and switches employed in the machine of FIG. 1, FIG. 6 is a similar view to FIG. 1, but particularly shows relation between a path of copy paper and various switches, FIG. 7 is a perspective view of a toner dispenser and associated mechanisms therewith employed in the machine of FIG. 1, FIG. 8 (a) is a schematic side view explanatory of a copy paper sheet separating device employed in the machine of FIG. 1, FIG. 8 (b) is a perspective view of the copy paper sheet separating device of FIG. 8 (a), FIG. 8 (c) is a top plan view of a separating piece employed in the copy paper sheet separating device of FIG. 8 (a), FIG. 9 is a cross sectional view, on an enlarged scale, of a residual toner removing device employed in the copying machine of FIG. 1, FIG. 10 is an electrical circuit diagram illustrating various elements of the copying machine according to the present invention, FIG. 11 is a timing chart showing the sequence of operation for the copying machine of the present invention, FIG. 12 is a side sectional view of an important portion of an electrostatic copying machine according to a 2nd embodiment of the present invention, and FIG. 13 is an electrical circuit diagram illustrating connection between switches and light sources in the copying machine in FIG. 12.

Before the description of the present invention proceeds, it is to be noted that like parts are designated by like numerals throughout the several views of the accompanying drawings.

Referring to FIGS. 1 through to 9, the slit exposure type electrostatic copying machine according to the present invention generally comprises a drum 6a having a photoreceptor surface **6*b* on the outer periphery thereof and rotatably mounted on a shaft journaled in the frame of the housing T to rotate in the direction indicated by the arrow to cause the photoreceptor surface 6b sequentially pass various processing devices, such as a charger 8, an exposure adjusting vane 4, a developing device A, a transfer, charger 9, a copy paper sheet separation device B, and a residual toner removing device C each of which is disposed along the path of the photoreceptor surface 6*b*', a horizontally movable transparent platform 1 on which an original 5 to be copied is placed and which is provided above the drum 6*a* for the photoreceptor 6*b*, a main light source L1 for illuminating the original 5 which is provided below and adjacent to the platform 1, and an optical mirror and lens system for projecting the light rays from the original 5 onto the photoreceptor surface 6*b***.

The transparent platform 1 for the original 5 is movably supported by a pair of guide rails 95 which are attached in parallel to each other on opposite sides on the top portion of the housing T as is seen from FIG. 2, and is adapted to reciprocate horizontally in the directions indicated by the arrows by means of the main motor MM shown in FIG. 3.

Referring particularly to FIG. 1, between the platform 1 and the photoreceptor surface **6*b*, there is provided a dark room 2 which has an upper opening 2*a* and a lower opening 2*b* facing the platform 1 and the photoreceptor surface 6*b* respectively. The dark room 2 includes the optical system comprising the main light source L1 for illuminating the original 5 fixedly provided at the right side edge of the upper opening 2*a* so as to face the platform 1, a 1st mirror M1 fixedly provided below the platform 1 and inclined at approximately 45° with respect to the lower surface of the platform 1 for directing the light rays from the original 5 to a lens 3 enclosed in a lens tube 3*a* which is fixed to the left side wall of the dark room 2. The lens tube 3a has a mirror 3' at one end thereof, so that the light rays from the mirror M1 is further directed through the lens 3 to a 2nd mirror M2, which faces the lens 3 and is suitably inclined to transmit the light rays in turn to a 3rd mirror M3 fixed on the left side wall of the dark room 2 perpendicular to the platform 1. The light rays reflected by the 3rd mirror M3 are projected onto the photoreceptor surface 6*b* through a slit 4' formed between the exposure adjusting vane 4 and the mirror M3. A fan 7 is provided adjacent to and at the back of the main light source L1** for cooling the latter.

The photoreceptor surface 6b in the configuration of the drum comprises the drum 6 of a small diameter for example, a drum with diameter of approximately 140 mm, on the outer periphery of which a photosensitive material 6b in the form of a sheet consisting of, for example, polyvinyl carbazole and selenium is wound. The circumference of the photoreceptor drum 6 is adapted to be slightly longer than the length of the maximum size original to be copied.

Fixing the photoreceptor 6b in sheet form around the drum 6 may be effected by simply using an adhesivebacked tape or by employing a special fixture.

A supplementary light source L4 is provided adjacent to the slit 4' so as to project light to approximately the same portion of the photoreceptor surface 6b as that to be exposed by the light image from the original 5 illuminated by the main light source L1. The supplementary light source L4 is connected to the main light source L1 through a switch so that both light sources are turned on or off alternatively, i.e., when the main light source L1 is turned on, the supplementary light source remains off, and when the latter is turned on, the former is turned off.

In this manner, as soon as the latent image is formed on the photoreceptor 6b by the light image from the original 5 illuminated by the main light source L1 and the main light source L1 is turned off, the supplementary light source L4 is turned on, thus illuminating the non-latent image formed portion of the photoreceptor surface 6b so as to remove the unnecessary charge therefrom as the photoreceptor drum 6a rotates.

The developing device A extends across the width of the photoreceptor surface 6b and is substantially enclosed in a housing H except for an opening adjacent to the photoreceptor 6b whereat development of the latent image is effected, and an opening H1 upon which a toner powder dispenser 18 is positioned to replenish the toner powder depleted from the developer material during development of the latent image. The magnetic roller 12 comprises an outer cylinder 12' of a non-magnetic material extending the width of the housing H with three elongated bar magnets 11 enclosed in the outer cylinder 12' and extending nearly the full length of the cylinder 12'. The bar magnets 11 are fixed on a shaft 10 secured to side walls (not shown) of the housing H in such positions that their magnetic force fields intersect to effect formation of magnetic bristles of developer material upon the roller 12'. The outer cylinder 12' enclosing the bar magnets 11 therein is mounted on the shaft 10 so as to be rotatable relative to the fixed shaft 10 adjacent to the photoreceptor surface 6b and is adapted to rotate counterclockwise, in the same direction as the photoreceptor surface 6b, thus developing the latent image as the developer material in the form of magnetic bristles contacts the latent image bearing portion of the photoreceptor surface 6b during rotation. A regulating plate 13 for adjusting the length of magnetic bristles formed is provided in a position immediately below the point where the surface of the outer cylinder 12' is closest to the photoreceptor surface 6b so as to control the quantity of the developer material to be supplied to the photoreceptor surface 6b. A movable member 14 is provided close to the regulating plate 13, which member 14 is also used for regulating the quantity of the developer material to be supplied to the photoreceptor surface 6b, either by stopping the transport of the developer material when developing operation is not carried out or by moving it to such an extent that the member 14 does not contact the photoreceptor surface 6b. The timing for operating the member 14 is controlled by a second cam plate 118 (FIGS. 4 and 6) which is associated with the operation of the photoreceptor drum 6.

The developer material remaining on the surface of the outer cylinder 12' after being supplied to the photoreceptor surface 6b by the outer cylinder 12' is adapted to be scraped off the surface of the cylinder 12' by a scraper 15 provided adjacent to the cylinder 12' and falls onto a stirrer 16, by the rotation of which the developer material is effectively stirred and accummulates in a sump 17 provided at the lowermost portion of the housing H. The developer material thus pooled in the sump 17 is again attracted to the surface of the outer cylinder 12' by the action of the bar magnets 11 with the same operation as described above being repeated.

The toner powder dispenser 18 is provided above the scraper 15. As shown in FIGS. 6 and 7, a gear 19 is fixedly mounted on a driving shaft 19' of a developing motor DM and is connected by a belt 20 to another gear 21 also fixedly mounted on a shaft 21' which is rotatably supported at one end thereof in the frame of the apparatus. One end of an arm 22 is secured to the other end of the shaft 21', while a pin 23' extends outwardly at right angles from the surface of the other end of the arm 22. A roller 23 is rotatably mounted at the other end of the pin 23' and is slidably received in an elongated slot 25 formed in a driving lever 24. At one end of the driving lever 24 facing the lower part of the toner dispenser housing 28, a pin 26 with brush bristles 27 secured to the forward portion thereof extends at right angles from the surface of the lever 24 into the housing 28. The rotation of the developing motor DM is transmitted to the arm 22 through the gear 19, the belt 20 and the gear 21 to rotate the arm 22, while the roller 23 for the arm 22 reciprocates in the slot 25 of the lever 24 so as to vibrate the lever 24 relative to the shaft 26. Accordingly, the brush 27 secured to the shaft 26 is adapted to rub against a slit 29 formed in the bottom portion of the toner dispenser housing 28, thus dropping the toner powder onto the sump 17 (FIGS. 1 and 6) while falling. The toner powder falls on the stirrer 16 and is mixed well with the residual toner particles scraped off the outer cylinder 12'.

The latent image of the original 5 formed on the photoreceptor surface 6b after the latter is charged by the charger 8 and exposed by the light image from the original 5 is developed by the developing device A and thereafter reaches, as the photoreceptor drum 6 rotates, the transfer position, whereat a copy paper sheet is fed and the toner image on the photoreceptor surface 6b is transferred onto the copy paper sheet by means of the transfer charger 9.

The construction and operation of the paper feed device will be described hereinbelow.

A roll of copy paper 30 is rotatably supported by a shaft 31 which is fixed on a side wall of the apparatus. The leading end of the web of paper from the roll 30 is held between a pair of feeding rollers 32 and subsequently transported toward the photoreceptor drum 6 as the rollers 32 rotate and is adapted to be cut into a required length by means of a cutter 33. A loop roller 34 is provided in a path of the web of paper between the cutter 33 and a pair of first paper feed rollers 35 and is adapted to move upward to downward. While the web of paper is cut and transported, the loop roller 34 is in a lowered position by its own weight with the copy paper transported along the lower face of the roller 34. When the cutter 33 is to be operated, the rollers 32 are adapted to stop with the first rollers 35 rotating, so that the loop roller 34 is raised upward against its own weight by the tension of the copy paper between the rollers 32 and 35. Since the cutter 33 is adapted to function in this state, the web of paper which is kept in a state of tension by the weight of the loop roller 34 is cut to a correct size without any damage due to uneven pull or any irregularity at the cut edge. The copy paper sheet thus cut from the web of paper is further transported through the guide plates 36 and held at the leading end thereof by a pair of second feed rollers 37, the rotation of which further feeds the copy paper sheet to the transfer position for the photoreceptor drum 6 through a guide plates 38. Along the above path of the copy paper sheet, scanning switches SW31 and SW32 for the platform 1 are provided to detect the transportation of the copy paper sheet, the signals from which are adapted to energize a locking solenoid SL5 (FIG. 3) so as to move the platform 1 by releasing the platform locking device 96 which prevents the platform 1 from moving.

In cases where special size of copy paper or infrequently used sizes of copy paper are to be copied, a manual insertion table 39 for copy paper sheets is rotatably provided on a shaft 40 secured to the copying apparatus T. By turning the table 39 relative to the shaft 40 to a position shown by dotted lines in FIG. 1, a switch SW42 for manual insertion (FIG. 6) is adapted to be turned off, which will be mentioned later. In this state, a pair of rollers 41 for manual insertion are continuously rotating to feed the copy paper sheet inserted through the table 39 toward the photoreceptor drum 6. However, if the platform 1 or the photoreceptor drum 6 is not in the starting position for copying, the manual insertion of the copy paper sheet is made impossible by means of a stopper 42 which is operated by a solenoid SL2 (FIG. 6) so as to close the passage of the copy paper sheet. When the platform 1 and the photoreceptor drum 6 are in the starting position for copying, the copy paper sheet inserted manually through the table 39 is transported through the pair of rollers 41 for manual insertion, guide plates 43, along the lower face of the loop roller 34 and through the first rollers 35 to the photoreceptor drum 6 in manner similar to that described above.

It should be noted that in the copying machine according to the present invention, the manual feeding of copy paper sheets can be easily done by simply opening the table 39 for manual insertion with the roll of copy paper always stored in the apparatus and that, since the manual insertion of the copy paper sheets is made possible only when the platform 1 and photoreceptor drum 6 are in the detected starting positions, no operational error takes place.

The copy paper sheet thus fed to the transfer position on the photoreceptor surface 6b closely contacts the latter by means of the transfer charger 9 with the toner powder image formed on the photoreceptor surface 6b transferred to the copy paper sheet. Since the charge by the charger 9 is of opposite polarity to that of toner particles, the toner image is effectively transferred onto the copy paper sheet. Thereafter, the copy paper sheet electrostatically attracted to the photoreceptor surface **6*b* and on which the toner powder image is transferred reaches the separation position at the leading edge thereof and is separated from the photoreceptor surface 6b by the copy paper sheet separation device B mentioned below, then attracted by an air suction belt device 44 provided below the drum 6 and transported into the fixing device D by the belt 45. There is provided suction box 46 below the belt 45** in which a suction fan SF is installed.

Referring to FIGS. 6 and 8, the copy paper sheet separation device B generally comprises a shaft 50 which is rotatably supported in the wall of the copying apparatus T, a separating member 51 of L shape which is rigidly fixed to the shaft 50 at the bent end thereof and which has one or a plurality of separating pieces 52 suitably attached to the other end thereof, and a U-shaped balance weight 53 secured to the shaft 50 in parallel to the member 51, but extending in the opposite direction to the member 51 as seen in FIG. 8(b). Thus, the separation piece 52 is adapted, by the balance weight 53, to contact the photoreceptor surface **6*b* with such a light pressure that it will not damage the surface 6*b* with clockwise moment of the piece 52** slightly larger than counterclockwise moment thereof.

According to the experiment, optimum results were obtained when a nail-shaped plastic film sheet of 100 to 200 $\mu$ thickness, as shown in FIG. 8(c), was used with such dimensions as $a = 10$ to 50 mm, $b = 1$ to 5 mm, $c$, $= 5$ to 10 mm and $d = 10$ to 50 mm respectively.

In determining the above dimensions, the separation of the copy paper sheet can be done effectively without unnecessary contact of the separation piece 52 with the photoreceptor surface **6*b***, if the contact between the two is reduced by selecting $b$ to be small length with dimensions of $a$, $b$ and $c$ determined or better resilience.

An L shaped member 54 is pivotally supported, at the bent corner thereof, close to a first cam plate 114 mounted on the same shaft 109 as the drum 6 (FIG. 4), on a pin 55 fixed to the apparatus T as in FIGS. 8(a) and 8(b). The member 54 is urged in the counterclockwise direction by a spring 56 so that a pin 57 extending outwardly at right angles from one end of the member 54 contacts the balance weight 53 secured to the shaft 50 to which the separation member 51 with the clockwise moment is also fixed, as described earlier.

On the other hand, the pin 57 of the member 54 is adapted to be slidably received in a guide slot formed in the side wall of the apparatus T, and is usually positioned at the upper part of the slot so that the separating piece 52 is away from the photoreceptor surface **6*b* in order to prevent the piece 52 from damaging the surface 6*b* or to protect the same from soiling by the residual toner powder on the surface 6*b*** after development.

A cam 59 is fixed on the first cam plate 114 which is rotatably mounted on the same shaft 109 as the drum 6 (FIG. 4), and as the first cam plate 114 rotates, the cam 59 is adapted to contact the extending end **54*a* of the member 54 so as to rotate the member 54** in *a* clockwise direction relative to the shaft 55 against the urging force of the spring 56. The cam 59 is fixed on the cam plate 114 in such a position that the end **54*a* of the member 54 contacts the cam 59 some time before the leading edge of the copy paper sheet reaches the front edge of the separating piece 52.**

Accordingly, immediately before the leading edge of the copy paper sheet with the toner powder image thereon reaches the separating piece 52 as the drum 6 rotates, the cam 59 fixed on the first cam plate 114 rotating on the same axis as the drum 6 pushes the end 54*a* of the member 54 so as to rotate the member 54 in the clockwise direction relative to the shaft 55 against the urging force of the spring 56. The rotation of the member 54 releases the contact between the member 54 and the balance weight 53 with the separating piece 52 rotating due to the clockwise momemt by the balance weight 53 and contacting the photoreceptor surface 6*b* with very slight pressure. Almost simultaneously with the above contact, the leading edge of the copy paper sheet engages the separating piece 52 with the copy paper sheet electrostatically adhering to the photoreceptor surface 6*b* but separated from the surface 6b, and the leading portion of the copy paper sheet is subsequently attracted by the action of the air suction belt device 44 and fed into the fixing device D (FIG. 1). After the member 54 is rotated momentarily clockwise upon contact with the cam 59, by which the separating piece 52 contacts the photoreceptor surface 6*b* to separate the leading edge of the copy paper sheet from the surface 6*b*, the contact between the member 54 and the cam 59 is adapted to be released and the member 54 returns to the original position by the urging force of the spring 56.

The charge on the copy paper sheet with the toner powder image thereon is neutralized by the paper discharger 60 while the sheet is transported toward the fixing device D.

A shutter 61 (FIGS. 1 and 6) for fixing is rotatably mounted on a shaft 62 at the entrance of the fixing device D, and the shutter 61 for fixing is actuated through a shutter solenoid SL1(FIG. 6) by operation of a print switch SW1(FIG. 10) as described hereinafter and is adapted to rotate to a position shown by dotted lines in FIG. 1. Thus, in a condition where the shutter 61 for fixing is open, the copy paper sheet having the toner powder image thereon is fed into the fixing device D. The toner powder image is heated by a panel heater H1 and a tube heater H2 mounted inside for fixing device D, and fixed on the copy paper sheet, and discharged onto a tray (not shown) by exhaust rollers 63 and 64.

In the above case, a temperature detecting element Th (FIG. 10) is mounted near a panel heater H1 inside the fixing device D and the temperature inside the fixing device D is adapted to be regulated to a fixed value by a temperature adjusting circuit which is described later. Also, a faulty separation detecting switch SW33 and a jam detecting switch SW34 are mounted in the path of the copy paper sheet, and cooperate with a faulty separation detection switch SW24 and a jam detecting switch SW25 which are actuated by a projection 124 provided on a third cam plate 119 described later (FIGS. 4, 5 and 6) to detect the faulty transportation of the copy paper sheet for closing the shutter 61 for fixing. A buzzer Bz is operated through a memory relay RY2 described later (FIG. 10) to issue a warning with current flow to the panel heater H1 and the tube heater H2 stopped, whereby the spread the fire caused by the copy paper sheet clogging inside the fixing device D is prevented.

The air in the upper portion of the fixing device D is sucked by the suction fan SF and is exhausted outside the fixing device D through a passage 65 (FIG. 1) to prevent the temperature rise around the fixing device D.

As described hereinabove, the photoreceptor surface 6*b* from which the copy paper sheet is separated and which still has residual toner particles thereon has its electric charge reduced by, first, an auxiliary erasing lamp L3 and a discharger 66, and reaches the residual toner removing device C through the rotation of the drum 6.

Referring to FIGS. 1 and 9, the residual toner removing apparatus C of the present invention which extends across the width of the photoreceptor 6*b* of the copying machine generally comprises three sections communicating with one another; a cleaner section C1 including a cleaner brush 71 rotatably provided in a housing C1′, and a duct section C2 extending from said housing C1′ into a filter section C3 which is connected to a suction fan CF.

In the cleaner section C1, the bottom portion of the housing C1′ is formed into a concave lower casing 73 in the form of a trough for the cleaner brush 71. A small gap $\beta$ is formed between the front edge of the lower casing 73 and the photoreceptor surface 6*b* while the other edge of the casing 73 is bent horizontally to form a bottom portion of the duct section C2. A drum 71′ for the cleaner brush 71 with brush bristles 70 of animal fur such as rabbit fur or synthetic fur secured to the entire outer surface thereof is rotatably supported over the lower casing 73 by suitable means. Above the cleaner brush 71, there is fixedly provided a convex upper casing plate 72 which is electrically insulated from the lower casing 73 and divides the cleaner section C1 into two portions, i.e., the portion in which the cleaner 71 is enclosed and the air passage 75 formed between the upper casing 72 and the cleaner section housing C1′. The front edge of the casing 72 is spaced away from the photoreceptor surface 6*b* to a certain extent to provide a small gap $\alpha$ therebetweeen, while the rear lower part of the casing 72 is in integral connection with a short flat portion 72′ extending horizontally into the duct section C2. The tips of the brush bristles 70 are adapted to rub against the inner face of the upper casing 72, keeping a fixed distance from the inner face of the lower casing 73 to form an air passage 74 during rotation, while applying very slight pressure to the photoreceptor surface 6*b* at a contact gap *c* formed between front edges of the casings 72 and 73. There is also provided a small gap $\alpha$ between the upper front edge of the cleaner section ousing C1′ and the photoreceptor surface 6*b*. A flicker rod 76, which extends across the width of the housing C1, and is fixedly supported in the housing side walls, not shown, is located in the path of said brush bristles 70 between the flat rear portion 72′ of the casing 72 and the rear portion of the lower casing 73 leading to the duct section C2, while an air flow regulating plate 77 which also extends across the width of the flicker rod 76 is fixedly attached to the rod 76, extending approximately horizontally, with its rear free edge slightly raised upward, from the rod 76 to a middle portion of said duct section C2, thus forming an air passage a between the plate 77 and the bottom portion of the duct section C2.

The end portion of the duct section C2 remote from the cleaner section housing C1 projects into the filter section C3 of a box shape to a certain extent through a corresponding opening formed in the filter housing C3 and tightly connected to the mouth of a filter bag 78 contained in the filter housing C3 which is connected to a suction fan CF.

Operation of the abovedescribed apparatus is as follows. The portion of the photoreceptor surface 6b, the toner powder image on which has been transferred onto a copy paper sheet, and to the surface of which there are still attached remnant toner particles, is brought by the drum 6a, which rotates counterclockwise at a moderate speed, into the contact gap *c* of the residual toner removing apparatus C, and is there contacted by the brush bristles 70 of the cleaner brush 71 which is also rotated counterclockwise, but at a higher speed, thus the remnant toner particles being wiped off the surface of the photoreceptor surface 6b. Simultaneous rotation of the fan CF draws air through the gap $\beta$ into the space 74, causing an air flow in the direction of an arrow *a*. In the meantime, toner particles adhering to the brush bristles 70 are detached from the bristles 70 when the latter strike against the flicker rod 76, and carried by the above air flow through the gap $\beta$ space 74 and the air passage a into the filter bag 78 in the filter section C3.

It should be noted that the air flow regulating plate 77 fixed to the flicker rod 76 is particularly effective in directing the air flow containing the toner particles in the direction of the arrow *a* and sending the same efficiently into the filter bag 78 in cooperation with the suction by the fan CF.

Furthermore, since the above air flow regulating plate 77 also acts as a wind direction shifting plate and a partition, no air vortex is caused at the back of the flicker rod 76 and the toner particles are effectively carried in the direction of the arrow a without scattering thereabout or sticking back to the brush bristles 3.

Toner particles still remaining on the brush bristles 70 even after the bristles 70 have struck against the rod 76 are discharged through the gap $\alpha$ into the passage 75 as the cleaner brush 70 rotates and drawn in the direction shown by an arrow b by the air flow caused by the fan CF into the filter bag 78 in the filter section C3. Since air is also drawn into the passage 75 in the direction of the arrow b through the gap $\gamma$ by the action of the fan CF, the toner particles discharged into the passage 75 through the gap $\alpha$ never scatter out of the apparatus through the gap $\gamma$. The brush bristles 70, from which the toner particles have almost completely been removed in the above manner, again contact the photoreceptor surface 6b, repeating the same procedure as described above the air flow regulating plate 77 is not necessarily an element separate from the flicker rod 76 but may be in integral connection with the flicker rod 76. For example, the flicker rod 76 may be formed from a sheet of metal by rounding one edge thereof to make the rod 76 and plate 77 integral. Similarly, the lower casing 73 may be separately formed and connected to the bottom portion of the duct section C2.

Furthermore, if a suitable baffle plate (not shown) is provided in the filter bag 78 so as to cause the air flow regulated by the air flow regulating plate 77 to collide with the baffle plate, most of the air entrained toner particles fall and accumulate in front of the baffle plate with little possibility of the clogging of the entire filter screen, thus resulting in a prolonged optimum filtering efficiency and a small size of the filter bag 78.

As described hereinabove, the photoreceptor surface 6b which has been cleaned moves to a position facing a main erasing lamp L2 through its rotation, and is illuminated by the main erasing lamp L2, whereby the electric charge remaining on the photoreceptor surface 6b is completely removed. The copying operation is adapted to be repeated in the same manner as described hereinabove.

Now, referring to FIG. 3, a driving system connected with a main motor MM, a development motor DM and a cleaning motor CM will be described.

Rotation of the main motor MM is transmitted to the hand insertion rollers 41, and the first and second paper feeding rollers 35 and 37 through a chain 80, and is also adapted to be transmitted to the paper feeding rollers 32 in cooperation with the operation of a paper feeding clutch CL4. On the other hand the rotation of the main motor MM is transmitted to a chain 82 through a sprocket 81 composed integrally with the second paper feeding rollers 37, and the driving force transmitted to the chain 82 is in turn transmitted to a roller 84 and a gear 85 which are supported coaxially and rotated integrally through a sprocket 83. The turning force transmitted to the roller 84 drives the carrying belt 45, while the turning force of the gear 85 is transmitted to a gear 87 through a gear 86 to rotate a sprocket 88 form integrally with the gear 87. The turning force is transmitted to sprockets 90 and 91 through a chain 89, and is adapted to be transmitted to exhaust rollers 63 and 64 form integrally with these sprockets 90 and 91. Furthermore, the turning force of the main motor MM drives a chain 92, and the driving force is transmitted to a rack 94 secured to the platform through a gear 93 in cooperation with the operation of a scan clutch CL2 or a return clutch CL3. Thus, the platform 1 is adapted to reciprocatingly move in the direction of arrows along guide rails 95 (FIG. 2).

The platform locking device 96 is adapted to hold the platform 1 in a predetermined position. There is provided a knob 97 for random cutting, which is adapted to cut the web of paper from the paper 30 to a desired length. Depression of a paper cut switch SW14 actuates a cutter solenoid SL3 (FIG. 6) described later through a lever (not shown integrally form with the knob 97 for random cutting to cut the web of paper from the paper roll 30 to a desired length. A lock detecting switch SW15 is adapted to detect the movement of the locking device 96. Closure of the switch SW15 actuates a relay RY5, (FIG. 10) etc., as described later, to stop the current flowing in the panel heater H1, turns on the exposure light source L1 through an overrun switch SW16, actuates the platform 1 and the photoreceptor drum 6, and also turns on a waiting lamp PL1 to show that the copying machine is ready for the next copying operation.

On the other hand, driving force of the developing motor DM is transmitted to a chain 99 through an output sprocket 98, and sprockets 100 and 101 are rotated by the chain 99 so as to rotate the developing outer cylinder 12' and the brush 27 for the toner dispenser 18.

Also, the turning effort of the cleaning motor CM is transmitted to a chain 103 and a chain 104 through an output sprocket 102, the chain 103 being adapted to drive a cooling fan 7 for the exposure lamp L1 while the chain 104 drives the cleaner brush 71.

Subsequently, the driving operation of the photoreceptor drum 6, and a driving system connected with the driving operation will be described hereinafter with reference to FIG. 4.

The driving force of a main motor MM is transmitted to a sprocket 105 through a chain 92 (FIG. 3). Since the sprocket 105 is secured to a shaft 106, operation of a drum clutch CL1 as described hereinafter transmits the driving force to the drum shaft 109 through gears 107 and 108, whereby the photoreceptor drum 6 is adapted to rotate integrally with the drum shaft 109.

The drum shaft 109 is secured to frames 112 and 113 of the apparatus T by bearings 110 and 111, while the photoreceptor drum 6 is removably mounted on the drum shaft 109. Not only the photoreceptor drum 6, but also the first cam plate 114 and a gear 115 are secured to the drum shaft 109 through a sleeve 116 similarly to the gear 108, and a second cam plate 118, a third cam plate 119 and a gear 120 are mounted on the shaft 109 through a bearing 117 rotatably mounted on the drum shaft 109.

Rotation of the gear 115 is transmitted to the gear 120 through gears 121 and 122, and the second cam plate 118 and third cam plate 119 are adapted to rotate at a speed one half that of the photoreceptor drum 6.

As shown in FIG. 6, the first cam plate 114 is a cam which determines the operation timing of the separating piece 52 for separating the copy paper sheet with the timing transmitted to the separating piece 52 through the separating member 51, while the second cam plate 118 determines the operation timing of the movable member 14 for the developing device A which regulates the amount of the developing toner with the timing transmitted to the movable member 14 through a lever 123. a projection 124 is provided on the third cam plate 119, and is adapted to actuate drum position switches SW21, SW22, SW27, a faulty separation detecting switch SW24, a jam detecting switch SW25 and a multicopy paper feeding switch SW23, the position of each switch being shown in FIG. 5.

Subsequently, feeding operation of the copy paper and a driving system therefor will be described hereinafter with reference to FIG. 6.

A condition where the reproduction has just started is shown in FIG. 6, at which time the second and third cam plates 118 and 119 are positioned as illustrated with the leading end of the web of paper from the roll paper 30 located in the cutter 33.

By depressing a print button (not shown), a print switch SW1 (FIG. 10) is temporarily closed as described later, and the paper feeding clutch CL4 is operated to rotate the paper feeding rollers 32, whereby the feeding operation of the copy paper is started.

Thereafter, the copy paper is cut into a sheet form by operation of the cutter 33 as described later. When the cut copy paper sheet depresses the platform scan switch SW31, disposed on its moving path, travel of the platform 1 in a scanning direction, and driving operation of the photoreceptor drum 6 are started. As the photoreceptor drum 6 rotates, passing through various processings, such as charging, exposure, developing, transfer, separation of copy paper, cleaning and discharging, cam plates 114, 118 and 119 are also rotated, as described hereinabove, each cam plate 114, 118 and 119 controlling operation of the separating piece 52, the opening and closing of the movable member 14, the driving and stopping of the developing motor DM and also the multi-copy paper feeding operation by the third cam plate 119.

Returning operation of the platform 1 is effected as follows immediately after the copy paper sheet has passed the platform scan switch SW32, which is disposed along the path of the copy paper sheet.

Corresponding to the faulty separation detecting switch SW24, and the jam detecting switch SW25 which are actuated by the third cam plate 119, the faulty separation detecting switch SW33 is mounted on the path of the copy paper sheet and the jam detecting switch SW34 is mounted at the outlet of the fixing device D to detect the faulty transportation of the copy paper sheet.

Hand insertion of the copy paper sheet is described hereinafter.

A lever 125 is mounted on the table 39 for hand insertion. When the table 39 for hand-insertion is closed, the lever 125 depresses a hand-insertion switch SW42, while upon opening of the table 39, the lever 125 is separated from the hand-insertion switch SW42 to prevent the feeding from the paper roll 30.

Upon opening the table 39 for hand-insertion when the platform 1 and the photoreceptor drum 6 are located in the fixed positions (namely, the copying starting position), a hand solenoid SL2 is operated through the hand insertion switch SW42, the platform position switch SW11 and the drum position switch SW22, opening the stopper 42 for hand insertion so as to allow the copy paper sheet to be manually inserted.

Thus, the copy paper sheet inserted depresses the platform scan switch SW31 located along the path of the former with the same operation as in roll paper feeding as described hereinabove started.

Control mechanism of the electrostatic copying apparatus of the invention will be described hereinafter with reference to a timing chart shown in FIG. 11.

FIG. 10 shows an electric circuit diagram having control circuits which compose control mechanisms for the each section of the apparatus. Namely, in the AC circuit wherein a main switch MS, a main relay RY1, a suction fan SF, a panel heater H1, a tube heater H2, a relay RY3, a memory relay RY2, an exposure lamp L1, a developing motor DM, a high voltage transformer HT1, a developing bias unit Ba including a bias transformer PT2, a main erasing lamp L2, an auxiliary erasing lamp L3, a cleaning motor CM, a main motor MM, a cleaner fan CF, etc. are connected, the DC circuit (not shown) and DC circuit comprising a shutter solenoid SL1, a supplementary erasing lamp L4, a drum clutch CL1, a waiting lamp PL1, a relay RY4, a print switch SW1, a hand insertion solenoid SL2, a return clutch CL3, a scan clutch CL2, a cutter solenoid SL3, a paper feeding clutch CL4, a lock solenoid SL5, and a relay RY5 are connected to a temperature control circuit Y and a voltage setting circuit E respectively through a relay contact RY3-3 and a rectifier Rf.

The main relay RY1 and the relay contact RY2-1 for the memory relay RY2 are connected to the main switch MS.

Since the relay contact RY2-1 is normally closed, depression of the main switch MS actuates the main relay RY1. When the main relay RY1 is actuated closing relay contacts RY1-1, RY1-2 and RY1-3, the tube heater H2, the panel heater H1 and the waiting lamp PL1 start their operation respectively, at which time the waiting lamp PL1 is energized through a diode Da3.

At this time, as the temperature detecting element Th including a thermistor, etc. is provided near the panel heater H1, the temperature control circuit Y comprising the temperature detecting element Th is adapted to render the heater H1 and the thyristor S1 connected to the heater H1 conductive to flow current continuously until temperature inside the fixing device D rises to the level close to the temperature necessary for fixing, upon closure of the relay contacts RY1-1 and RY1-2, and is adapted to be controlled by a proportional control (phase control) when the temperature rises close to the fixing temperature. Both ends of the thyristor S1 (or both ends of the heater H1) are connected to the voltage setting circuit E through a relay contact RY3-1, the RY1-1 and a diode Da1, and the voltage is set to a voltage value approximately corresponding to the temperature for fixing. When the voltage of the thyristor S1 (or the heater H1) has reached the set value, the voltage setting circuit E is actuated to make the thyristor S2 conductive to operate the relay RY3. The relay RY3 is retained by the relay contact RY3-1, and a contact RY3-2 is closed to actuate the suction fan SF. The contact RY3-3 is closed to the cleaner fan CF side, operating the cleaner fan CF upon turning off the waiting lamp PL1 which has been energized through a diode Da3 and also energizing the DC circuit through a rectifier Rf, whereby the preparation for copying is completed.

Thereafter, a print switch SW1 is temporary closed by depressing a print button (not shown). At this time, if the photoreceptor drum 6 and the platform 1 are located in their starting positions, the drum position switch SW22 and the platform position switch SW11 are closed respectively. The relay RY4 is energized and operated upon closure of the print switch SW1.

Upon operation of the relay relay, the RY4-1 is self-retained with the contact RY4-1 thereof closed through a normally-closed cutter-on switch SW41, while a contact RY4-3 is closed to operate the shutter solenoid SL1 thereby to open a shutter 61 for fixing. A contact RY4-2 is closed to operate the paper-feeding clutch CL4 through a paper cut switch SW14 thereby to feed the web of paper from the roll 30 (FIGS 1 and 6).

When the leading end of the web of paper reaches the platform scan switch SW31 after starting of the paper feeding operation, the switch SW31 is closed to operate the lock solenoid SL5 (FIG. 3).

Upon operation of the lock solenoid SL5, the platform lock mechanism 96 is moved. The lock detecting switch SW15 detects the movement, and is closed to energized the relay RY5 for operation.

Upon operation of the relay RY5, the contact RY5-1 is opened to render the thyristor S1 nonconductive, and the current flowing to the panel heater H stops. A contact RY5-2 is closed, and the diac S3 and the thyristor S4 are rendered conductive to flow current to the exposure lamp L1 (namely, the heater H1 and the exposure lamp L1 are turned on alternately.)

Upon switching of a contact RY5-3 for the relay RY5, the drum clutch CL1 is operated whereby the photoreceptor drum 6 starts to rotate.

Drum position switches SW21, SW22 and SW27 which are operated by a projection 124 of the third cam plate 119 are depressed by the projection 124, respectively, when the third cam plate 119 is located in a fixed position. However, when the photoreceptor drum 6, and the third cam plate 119, which turns in association with the drum 6 at a speed one half that of the drum 6, rotate with the projection 124 leaving each of the switches SW21, SW22 and SW27, the contact of the switch SW21 is closed and the contact of the switch SW22 is closed to the drum clutch CL1 side with the contact for the switch SW27 closed.

Upon closure of the contact of the switch SW21, the shutter solenoid SL1 is operated to open a shutter 61 for fixing.

Upon closure of the contact of the switch SW22, the operation of the drum clutch CL1 is continued, and the photoreceptor drum 6 and the third cam plate 119 keep rotating until the third cam plate 119 reaches a predetermined position.

Upon closure of the contact of the switch SW27, the current flows in the high voltage transformer HT1, the developing bias unit Ba, the main erasing lamp L2, the auxiliary erasing lamp L3, and the cleaning motor CM respectively.

The charger 8, the transfer charger 9, the discharger 66 and the paper discharger 60 are connected to the high voltage transformer HT1. The developing bias unit Ba is adapted to impress upon the outer cylinder 12 of the developing device a potential with the same polarity as that of the photoreceptor surface **6*b*** for preventing overdevelopment.

Operation of each of the above elements by the switches SW21, SW22 and SW27 is effected until the photoreceptor drum 6 and the third cam plate 119 return to their fixed positions.

When the platform 1 moves in the direction of scanning (FIG. 3) and the switch SW14, which is operated by the knob 97 for random cutting has it contact closed to the cutter solenoid SL3 side, the current flowing to the paper feeding clutch CL4 stops, suspending the operation thereof, while cutter solenoid SL3 is operated to cut the web of paper from the roll 30 to a required size. The cutter-on switch 41 for confirming the starting of the cutter is mounted on the cutter 33. When the switch 41 is operated to open the contact thereof, the contact RY4-1 for the relay RY4 releases the self-retaining thereof. The contact RY4-2 opens a connection to the cutter solenoid SL3 and the paper feeding clutch CL4 to stop the operation of the cutter solenoid SL3, whereby the cutter 33 returns to the original position.

The platform scan switches SW31 and SW32 located on the path of the copy paper sheet are connected in parallel to each other. The positions of both switches SW31 and SW32 are determined (FIG. 1) so that the distance between the two switches SW31 and SW32 may be shorter than the length of the copy paper sheet of the smallest size. While the copy paper sheet passes between the switches, SW31 and SW32, both switch contacts or a contact of either one of the switches are closed. When the trailing end of the copy paper sheet has left the switch SW32 located behind the switch SW31 in the path of the copy paper sheet, the contact of the switch 32 opens to stop the operation of the lock solenoid SL5 with the lock detecting switch SW15 detecting the movement of the lock mechanism to open the contact of the former, consequently de-energizing the relay RY5 to stop the operation thereof.

When operation of the RY5 returns to the original condition to close a contact RY5-1, the thyristor S1 becomes conductive with the panel heater H1 turned on, and a contact RY5-2 opens to render the diac S3 and the thyristor S4 nonconductive with the current flow to the exposure lamp L1 ceased to turn off the latter.

Upon switching of the contact RY5-3, the supplementary erasing lamp L4 is turned on through the drum position switch SW22 and the contact RY5-3. Simultaneously, by switching of the contact RY5-4, the current flow to the scan clutch CL2 stops to suspend the movement of the platform 1. The return clutch CL3 is actuated through the platform position switch SW12 and the platform 1 starts moving in the return direction. And when the platform 1 has returned to the original starting position, the platform position switch SW11 and SW12 operate. Upon switching of the contact for the switching SW12, the current flow to the return clutch CL3 stops to suspend movement of the platform 1 in the return direction.

Upon switching of the contact for the switch SW11, the waiting lamp PL1, which is on through the drum position switch SW22, is turned off, showing that the apparatus is ready for another copying operation.

On the other hand, a development starting switch SW26 which is depressed by the third cam plate 119 and operates the developing motor DM is connected in series with the developing motor DM, which is operated by the closure of the switch SW26, to effect the development.

In order to detect the unsuccessful transportation of the copy paper sheet, the faulty separation detecting switch SW24 and the jam detecting switch SW25 are mounted around the third cam plate 119, while the faulty separation detecting switch SW33 and jam detecting switch SW34 are provided on the transporting path of the copy paper sheet, in positions corresponding to the switches SW24 and SW25. The switches SW33, SW24 and the switches SW34, SW25 are connected in series, respectively, and connected to the SET side of a memory relay RY2 to detect the faulty separation of the copy paper sheet and the jamming within the fixing device D.

When the copy paper sheet reaches the switch SW33, the contact for the switch SW33 opens and is adapted to close after the copy paper sheet passes. The operational timing is arranged in such a manner that when the projection 124 of the third cam plate 119 depresses the switch SW24 the contact of the latter is closed, and during the normal transportation of the copy paper sheet, the contact for the switch SW24 is adapted to close for only a short period of time within the time during which the contact for the switch SW33 is open. Accordingly, as the switch SW24 is closed after the switch SW33 has been opened, the memory relay RY2 does not operate. When the copy paper sheet has not been separated from the photoreceptor surface 6*b* closely adhering to the latter, the switch SW24 remains closed, whereat the memory relay RY2 operates to detect the unsuccessful separation.

A similar method is employed in detecting the paper jamming within the fixing device D.

Upon operation of the memory relay RY2, the contact RY2-1 opens to suspend the operation of the relay RY1 and the contact RY2-2 closes to sound the buzzer Bz for warning.

And the other elements except the suction fan SF stops the current flowing from the power source by the contact RY1-1, RY1-2 and RY1-3 for the relay RY1. The memory relay RY2 can be released from operation by depressing a releasing switch SW2.

When the copy paper sheet to be inserted is longer than the limited length for the apparatus in copying by manual operation, or when the cutter 33 has not operated normally because of some cause and has not been able to cut the copy paper sheet in copying on the web of paper from the paper roll 30, the platform scan switch SW32 can not detect the trailing end of the copy paper even if the platform 1 travels to it moving limit, and as the platform 1 does not return, it can be confirmed that the table has overrun. Namely, overrun switches SW13 and SW16 for detecting the overrunning of the platform 1 are provided as a safety mechanism in such cases, so that the switches SW13 and SW16 may be depressed, for effecting their functions, by a projection (not shown) mounted on the platform 1. Switching of the contact of the switch SW13 stops the operation of the scan clutch CL2 and in turn the platform 1, while opening of the contact of the switch SW16 stops the current flow to the exposure lamp L1 with the exposure lamp L1 turned off.

As described hereinabove, according to the present invention, since the photoreceptor drum is adapted to make two revolutions per copying cycle, and to stop at its starting position at each copying cycle, with the entire circumference of the photoreceptor drum slightly longer than the length of the maximum size of the original picture, when the photoreceptor of a sheet form wound around the drum is employed, it is possible for the photoreceptor drum to be small, in size, to a minimum limit required for carrying out an effective reproducing process, which fact, together with the adoption of the slit exposure system, leads to the compact size of the copying apparatus on the whole. Furthermore, since the copy paper feeding from the paper roll to the manual insertion can be easily effected by simply opening the manual insertion table and the paper roll feeding is adapted to be hindered while the manual insertion table is open, the apparatus can be positively operated with ease, making it possible to be employed in various purposes.

Also, since the starting of the photoreceptor drum is adapted to be effected, in timed relation to the movement of the copy paper, the copying apparatus of the present invention is highly efficient and reliable in bringing the copy paper sheet exactly under the latent images formed on the photoreceptor surface of the small sized drum.

Referring to FIGS. 12 and 13, there is shown a 2nd embodiment of the present invention as applied to a slit exposure type electrostatic copying machine similar to that described in the 1st embodiment. In this 2nd embodiment, the copying machine generally comprises a drum 6*a* having a known photoreceptor surface 6*b* on the outer periphery thereof which is adapted to rotate in the direction of the arrow by a conventional means through various processing stations, such as a charger 8, an exposure station, a developing station with a developing device A, a transfer station with a transfer corona charger 9, a residual toner removing device C, each of which is disposed sequentially along the path of the photoreceptor surface 6*b*, a horizontally movable transparent platform 1 to place the original 5 to be copied thereon which is provided above the photoreceptor surface 6*b*, a main light source L1 for illuminating the original 5 which is provided below and adjacent to the platform 1 and consists, for example, of a pair of xenon lamps, and a lens L provided between the platform 1 and the photoreceptor surface 6 *b* for directing the light image of the original 5 onto the photoreceptor surface 6*b* to form an electrostatic latent image thereon.

Below the drum 6*a* for the photoreceptor 6*b*, an endless belt V for transporting copy paper sheets is suspended by a pair of rollers V1 and V2, one of which is connected to a suitable drive means for driving the belt V. The surface of the belt V is adapted to contact the photoreceptor surface 6*b* at a position approximately in the middle of the forward run of the belt V immediately above the transfer corona charger 9 to form the transfer station B. A fixing device D is provided along the forward run of the belt V in a path of the copy paper sheet subsequent to the transfer station B.

During rotation of the drum 6*a*, the photoreceptor surface 6*b* is uniformly charged preliminarily by the corona charger 8. The light image of the original 5 placed on the transparent platform 1, and illuminated by the light source L1 is projected onto the photoreceptor surface 6*b* through the lens L and a slit (not shown) to form an electrostatic latent image on the photoreceptor surface 6*b*. The light source L1 is adapted to be turned on at the same time as the platform 1 with the original 5 thereon starts moving in the direction shown by the arrow so as to illuminate the original 5 and to be turned off when the platform 1 has moved a predetermined distance. These and other processes are effected in a known manner apart from the provision of the charging width control device of the invention.

A supplementary light source L4 is provided between the main light source L1 and the photoreceptor surface 6*b* in a position suitable for projecting light onto approximately the same portion of the photoreceptor surface 6*b* as that exposed by the light from the main light source L1. As is seen from FIG. 2, the main light source L1 and the supplementary light source L4 are connected in parallel to a power source E through a switch SWL. When the movable contact arm of the switch SWL contacts the stationary contact a thereof, the supplementary light source L4 is turned on with the main light source L1 turned off, and upon switching the movable contact arm of the switch SWL over to the stationary contact b, the light source L1 is turned on with the supplementary light source L4 turned off.

By this arrangement, during rotation of the drum 6*a*, when the main light source L1 is turned on to illuminate the original 5 and projects the light image of the original 5 onto the photoreceptor surface 6*b*, which is uniformly charged by the charger 8 so as to form the electrostatic latent image of the original 5 thereon, i.e., when the movable contact arm of the switch SWL contacts the stationary contact b, the supplementary light source L4 remains off, and when the latent-image formed portion of the photoreceptor surface 6*b* moves forward toward the developing device A as the drum 6 rotates, i.e., as soon as the main light source L1 is turned off with the movable contact arm of the switch contacting the stationary contact a, the supplementary light source L4 is turned on to illuminate the non-latent image formed portion on the photoreceptor surface 6*b* which is subsequent to the image-formed portion thereon and erases the electrical charge on the photoreceptor surface 6*b* imparted by the corona charger 8.

The electrostatic latent image which is formed on the photoreceptor surface 6*b* by the light rays from the original 5 illuminated by the main light source L1 is visualized upon contact with developer material such as toner particles at the developing device A as the drum 6 rotates in the direction of the arrow, which toner powder image is electrostatically transferred onto the copy paper sheet 30′ by means of the transfer corona charger 9 when the portion carrying the toner powder image contacts the copy paper sheet 30′ transported on the belt V. The copy paper sheet 30′ on which the toner powder image is transferred is further fed, by the belt V, into the fixing device D including a heating means so as to be fixed and discharged from the copying machine as a complete copy. The drum 6*a* is further rotated in the direction of the arrow after completion of the transfer to remove the residual toner particles from the photoreceptor surface 6*b* by means of the rotatary cleaner brush residual toner removing apparatus C and also to erase the remaining charge thereon imparted by the transfer corona charger 9 by means of a eraser lamp 12, thus the photoreceptor surface 6b completing a copying cycle, ready for another copying operation.

Since the charging width control device of the invention is provided with the switch by which the main light source and supplementary light source can be turned on and off alternately with the supplementary light source projecting light onto the portion of the photoreceptor surface at approximately the same portion thereof as that exposed to the light image by the main light source for removing unnecessary charge on the photoreceptor surface imparted by the corona charger, no complicated control, such as providing time lag between the functionings of the main light source and supplementary light source, is required as in the prior art, which results in compact size and light weight of the copying machine as a whole.

In the charging width control device of the invention, the charge on the non-latent image formed portion immediately in front of the latent image portion which is formed by the initial exposure by means of the main light source, can be readily erased before the formation of the latent image, so that the undesirable effect of uneven charge at the start of the charger is eliminated.

Furthermore, in the above device of the invention, since the charge is imparted only to the image forming portion of the photoreceptor surface, unnecessary potential increase at the portion without latent image by the transfer corona charger is avoidable, so that any dielectric breakdown due to abnormal discharge between the photoreceptor surface and the copy paper sheet as experienced in the prior art can be prevented with consequent prolonged life of the photoreceptor surface. The control circuit for the developing device can be made simpler, since the developing device needs not be controlled to the timing of the exposure.

It is another advantage of the charging width control device of the present invention that as the portion of the photoreceptor surface without the latent image is adapted to be electrically discharged in advance, the developer material is not consumed more than necessary, which fact is not only economical but also effective for lengthening the life of the residual toner removing device.

Although the present invention has been fully described by way of example with reference to the attached drawings, it is to be noted that various charges and modifications are apparent to those skilled in the art. Therefore, unless otherwise such changes and modifications depart from the scope of the present invention, they should be construed as included therein.

What is claimed is:

1. In a slit exposure type electrostatic copying apparatus which comprises a horizontally, reciprocating movable transparent platform to place an original to be copied thereon, a photoreceptor drum rotatably provided under said platform and having the surface thereof movable along a path relative to a plurality of processing stations, such as preliminary charging, exposing, developing, transferring, residual toner removing and discharging stations disposed along said path, each of said stations being actuable in timed relation to the rotation of said drum, means for feeding copy paper sheets, a main light source operatively positioned for illuminating an original to be copied, means for fixing toner powder images on said copy paper sheet and means for carrying said fixed copy paper sheets out of said copying apparatus, an improvement thereof for erasing the preliminary charge from said photoreceptor surface which comprises a supplementary light source for illuminating the portion of the surface of said photoreceptor drum on which no latent image is formed so as to remove unnecessary charge from said photoreceptor surface, said supplementary source being provided in the vicinity of said exposing station, a switch being operatively coupled to said main light source and said supplementary light source for turning said supplementary light source on only when said main light source is off as said photoreceptor drum rotates, said supplementary light source being directed toward approximately the same point along the path of movement of the surface of the photoreceptor drum as the point at which the light rays from said original are directed, said supplementary light source illuminating said photoreceptor surface only when it is turned on to remove unnecessary charge from the portion of the photoreceptor surface on which no latent image is formed, and said photoreceptor drum being adapted to complete one copying cycle per two revolutions thereof with said drum stopping at its starting position at every copying cycle.

2. A slit exposure type electrostatic copying apparatus as claimed in claim 1, wherein said copy paper feeding means comprises an automatic copy paper feeding mechanism having a roll of copy paper and a manual copy paper sheet insertion mechanism which can be selectively, alternately switched over to each other.

3. A slit exposure type electrostatic copying apparatus as claimed in claim 2, wherein said automatic copy paper feeding mechanism is provided with a cutter means which cuts a web of paper from said roll of paper into a required size and which is disposed along a path of said web of paper, said path of said web of paper being adapted to coincide with a path of copy paper sheet for said manual copy paper insertion mechanism at a position after said cutter means, said coinciding path leading to said transfer station through a plurality of pairs of rollers and guide plates and a microswitch actuated by said copy paper sheet being provided along said coinciding path for generating a signal for starting said platform and said photoreceptor drum.

* * * * *